United States Patent [19]

Gustafson

[11] Patent Number: 4,608,831

[45] Date of Patent: Sep. 2, 1986

[54] SELF-PRESSURIZING CONTAINER FOR CRYOGENIC FLUIDS

[76] Inventor: Keith W. Gustafson, Station 1101, Lake Arrowhead, Waleska, Ga. 30183

[21] Appl. No.: 664,285

[22] Filed: Oct. 24, 1984

[51] Int. Cl.[4] ..... F17C 7/02

[52] U.S. Cl. ..... 62/55; 222/131; 222/146.5; 219/271; 137/341

[58] Field of Search ..... 222/3, 4, 52, 53, 61, 222/130, 131, 152, 183, 146.1, 146.2, 146.5, 394, 396, 397; 62/50, 51, 55; 219/271, 272, 275, 314; 220/901; 137/339–341

[56] References Cited

U.S. PATENT DOCUMENTS

| | | | |
|---|---|---|---|
| 3,245,248 | 4/1966 | Ritter | 62/50 X |
| 3,272,964 | 9/1966 | Carlos et al. | 219/271 |
| 3,648,018 | 3/1972 | Cheng et al. | 222/146.2 X |
| 3,690,024 | 9/1972 | Osrow | 219/271 X |
| 4,201,319 | 5/1980 | Andrea et al. | 222/396 |
| 4,313,306 | 2/1982 | Torre | 62/51 |
| 4,472,946 | 9/1984 | Zwick | 62/55 |

*Primary Examiner*—Joseph J. Rolla
*Assistant Examiner*—Michael S. Huppert
*Attorney, Agent, or Firm*—Dale Lischer; J. Rodgers Lunsford, III

[57] ABSTRACT

There is disclosed a self-pressurizing container for liquid helium which comprises an inner and outer vessel with an insulating space between. A heating element is disposed within an insulating barrier tube which extends between the liquid and vapor phases of the helium. The barrier tube insures that the liquid helium is heated and vaporized in the barrier tube without substantially heating the bulk of the liquid helium. The heating element in the preferred embodiment includes a vapor heat exchanger.

7 Claims, 6 Drawing Figures

SELF-PRESSURIZING CONTAINER FOR CRYOGENIC FLUIDS

BACKGROUND OF THE INVENTION

This invention relates generally to self-pressurizing containers for cryogenic fluids and more particularly concerns a self-pressurizing container for the storage and distribution of liquid helium.

Helium is present in the atmosphere at a level of approximately one part per two hundred thousand. It is an inert by-product of radioactive decay, and because of its high molecular velocity, it continually escapes from the earth's atmosphere into space. Due to its relative scarcity in the atmosphere, its cost prior to 1915 was $2500 per cubic foot as a result of the high cost of separation. In 1915 helium was discovered in the natural gas wells in the southwestern United States. The world's helium supply for all practical purposes is distilled from these wells by large, on site plants and shipped worldwide from those sources in various sized liquid and high pressure tanks.

As previously stated the present invention relates to the handling of liquid helium. Liquid helium has the lowest boiling point of any element. Its boiling point of −450° F. is only approximately 7° F. above absolute zero. It takes very little heat (8.8 BTU per pound) to cause helium to boil at this temperature. Furthermore, it takes very little heat to increase the temperature of liquid helium (approximately 1.5 BTU per pound degree F.). Liquid helium is also very light in weight (0.94 pounds per gallon).

In transferring liquid helium from one container into another, it is necessary to build a pressure head in the helium vapor above the liquid helium without increasing the liquid's temperature substantially above its boiling point. If the liquid helium temperature is increased along with the increased pressure, high product losses will occur during the transfer process. This high loss is termed a flash-loss within the cyrogenic industry. Flash-loss is the extremely rapid boiling of the super heated liquid helium when it is depressurized. The same type of loss occurs when the lid is removed from a hot pressure cooker and all the water turns to steam. Because of the cost associated with obtaining liquid helium, it is important that flash-loss be kept to a minimum.

In the cryogenic industry, the standard procedure for building head pressure above liquid helium in a container is to connect a pressurized tank of helium gas to the liquid container. While this procedure provides sufficient head pressure and works adequately without substantial flash-loss, it requires the presence of a high-pressure cylinder of helium available on site and the necessary lines to make the connections for transfer.

In recent years, the demand for liquid helium has increased, particularly for use in super cooling magnets used in connection with magnetic resonance scanners. Such magnetic resonance scanners are used to provide images of the internal structure of the human body. In order to provide the proper resolution in such magnetic resonance scanners, it is necessary to have large magnets which are super cooled by the liquid helium. The presence of such large magnets make it impractical to have steel high-pressure cylinders available on site adjacent to the magnets because of the high magnetic fields that are involved.

While self-pressurizing containers for cryogenic fluids are known in the industry for fluids such as liquid nitrogen and liquid oxygen, such containers generally will not work when used in connection with helium. When liquid helium is used in such standard self-pressurizing containers, it is subject to a phenomenon known as the second sound oscillation which is in essence a thermal acoustical oscillation within the pressurized system.

SUMMARY OF THE INVENTION

It is therefore an object of the present invention to provide a self-pressurizing container for cryogenic fluids, particularly liquid helium, which container is not subject to thermal acoustical oscillations during pressurization.

In order to achieve the object of the present invention, the liquid helium container, comprising an inner and outer vessel, has an insulating barrier tube within the inner vessel which provides a path between the liquid and the vapor phase of the helium. A heating element is then inserted inside the barrier tube in order to heat a small quantity of the liquid helium within the barrier tube without heating a substantial portion of the rest of the liquid helium in the container. As a result, the liquid helium within the barrier tube is vaporized creating head pressure above the main body of the liquid helium.

In the preferred embodiment, the liquid helium inside the barrier tube is heated by drawing off a small portion of the helium vapor from above the liquid helium, heating it outside the container in a heat exchanger, conducting it through a second heat exchanger within the barrier tube, and then venting the warmed vapor to the outside of the container.

Finally, an automatic shutoff valve is provided at the outlet of the vapor vent in order to stop the transfer of vapor through the heat exchanger once sufficient head pressure has been built up.

Other objects and advantages will become apparent upon reading the detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
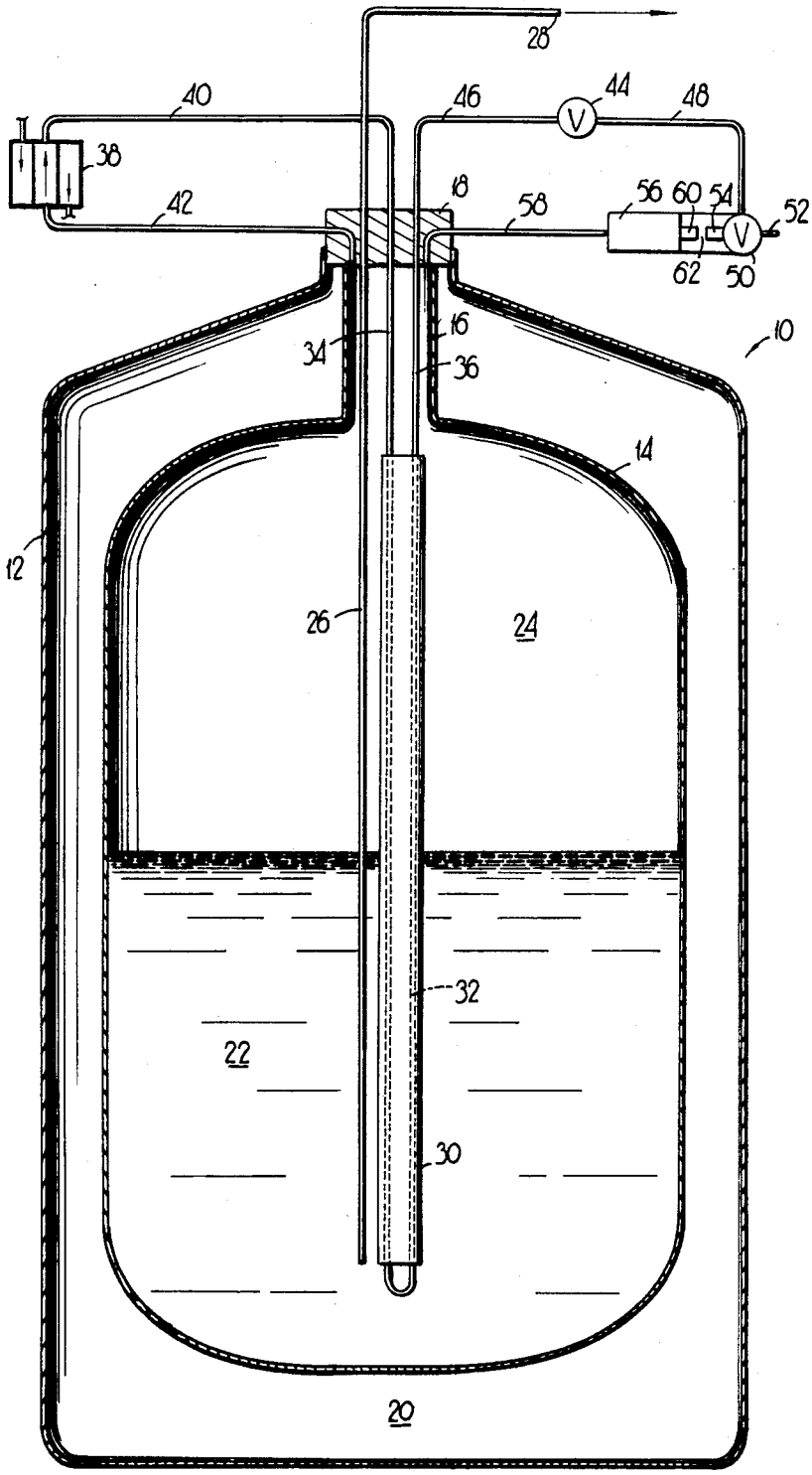
FIG. 1 is a schematic representation of a liquid helium container which embodies the present invention and is the preferred embodiment thereof.

Turning to FIG. 1 there is shown schematically the preferred embodiment of a liquid helium container 10 embodying the present invention. The liquid helium container 10 includes an outer vessel 12 and an inner vessel 14. The inner vessel 14 is supported within the outer vessel 12 by means of a neck 16 which leads to a sealable access port 18. There is an insulating space 20 between the inner and outer vessel which is a vacuum and may contain insulating material as well. The vacuum space 20 ensures that heat transfer between the contents of the inner vessel 14 and the outside of outer vessel 12 is minimized.

The inner vessel 14 contains liquid helium in its liquid phase 22 with a vapor phase of helium 24 disposed above the liquid 22.

A transfer tube 26 extends through the access port 18 and neck 16 and into the liquid helium in the bottom of the inner vessel. The outlet 28 of transfer tube 26 is then connected to a receiving receptacle through standard valves and connections (not shown).

In order to transfer liquid helium 22 in the inner vessel 14 out of the inner vessel through the transfer tube 26, it is necessary to increase the pressure above the liquid helium. As has been previously described, standard practice requires an additional pressurizing port connected to the interior of the inner vessel above the liquid helium to provide pressurized helium yapor from a separate pressure source. In the present invention, the container 10 is self-pressurized by vaporizing a small portion of the liquid helium within the inner vessel without substantially heating the bulk of the liquid helium so that the liquid helium does not rapidly boil away when it is depressurized upon reaching outlet 28.

In order to vaporize only a small amount of the liquid helium, an open ended barrier tube 30 is inserted into the inner vessel so that one end of the open ended barrier tube communicates with the liquid helium phase 22 at the bottom of the inner vessel and the other open end of the barrier tube 30 communicates with the vapor phase 24 near the top of the inner vessel. The barrier tube must be a low heat conductive material with respect to liquid helium and with respect to the low temperature differential experienced by the barrier tube. The barrier tube must also be able to withstand the low temperatures of liquid helium, and in the preferred embodiment of the invention, it is made of stainless steel. A heat source is then introduced inside the barrier tube near the bottom of the barrier tube so that the heat source is within the liquid helium. The heat causes the liquid helium within the barrier tube to vaporize, the vapor escapes through the top of the barrier tube, and the vapor pressure above the liquid helium is increased to provide the necessary head pressure to force the liquid helium out of the transfer tube 26. The barrier tube thus serves two functions. First, it is a conduit for the vaporized helium to the vapor space in order to increase the vapor pressure above the liquid helium in the inner vessel. Second, the barrier tube is a physical and thermal barrier preventing the heat from warming the main body of the liquid helium within the inner vessel.

Heat can be provided within the barrier tube in a number of ways such as heat exchangers, electric heating elements, conductive materials extending from outside of the vessel, etc.

In the preferred embodiment, the heating means within the barrier tube comprises a heat exchanger 32 which is a U-shaped pipe of heat conductive material with respect to the temperature differential between the liquid helium and the heated vapor. The U-Shaped pipe extends down through the barrier tube and back up again. The heat exchanger 32 is connected to an inlet pipe 34 and an outlet pipe 36 both of which enter the helium container through the sealable port 18 and extend down through the neck 16. The inlet pipe 34 is connected to heat exchanger 38 by means of a tube 40. The heat exchanger 38 may be outside of the container 10 or it may be integral with the wall of the outside vessel 12. The heat exchanger 38, which is at ambient temperature, receives helium vapor through pipe 42 that is connected through sealable access port 18 to the vapor space above the liquid helium.

The outlet tube 36 is connected to a manual shutoff valve 44 by means of a pipe 46. The outlet of the manual shutoff 44 is connected to a pipe 48 which is in turn connected to the inlet of a normally opened valve 50. The outlet 52 of valve 50 is vented to the atmosphere. The normally open valve 50 is controlled by means of a plunger 54. A pneumatic activator 56 receives pressure from the vapor space above the liquid helium by means of a tube 58. The pneumatic activator 56 in response to the pressure within the inner vessel above the liquid helium activates its plunger 60. The plunger 60 of the pneumatic activator and the plunger 54 of the normally closed valve are separated by a gap 62. In order to shut off normally open valve 50 it is necessary for the pressure of the vapor 24 in the inner vessel to build up sufficiently so that the plunger 60 of the pneumatic activator 56 spans the gap 62 to engage the plunger 54 of the normally open valve 50 and close valve 50.

The liquid helium container 10 is self-pressurized in the following manner. Initially valve 44 is closed so that no helium vapor can pass through the heat exchangers 32 and 38. In order to initiate the self-pressurization, valve 44 is manually opened. Because the pressure in the inner vessel is low to begin with, plunger 60 of pneumatic activator 56 is retracted and the normally open valve 50 is open.

Of course, there is always slight vapor pressure above the liquid helium because of the constant, albeit small, transfer of heat from the outside of the container into the inner vessel which pressure, during ambient conditions, is maintained by a relief valve (not shown). The relief valve is closed during self-pressurization so that transfer pressure can build up. The small vapor pressure within the inner vessel forces helium vapor 24 into tube 42 and into the heat exchanger 38, where it is warmed by the ambient air and returned through tube 40 and 34 to the heat exchanger 32 to warm and vaporize the liquid helium with the barrier tube. The tube 34 and 36 should be of a low heat conductive material so that the heated vapor retains its heat until it reaches the heat exchanger 32, and after shut-off, heat is not conducted to the vapor space. The warmed helium vapor passes through the heat exchanger 32, back up the outlet pipe 36, through the sealable access port 18, through tube 46, through yalve 44, and through normally open valve 50 to the atmosphere.

Because the heat capacity of the helium vapor is approximately 100 times greater than the heat of vaporization of the liquid, more vapor will be produced within the barrier tube 30 than is vented. As a result, as the heat is transmitted by the circulating vapor into the bottom of the barrier tube 30 more helium vapor is created than is vented so that the pressure in the vessel slowly builds up. As the pressure builds up above the liquid helium, the liquid helium is forced up through the transfer tube 26 to the outlet 28.

Also, as the vapor pressure builds up, the pneumatic activator 56 extends its plunger 60 until it spans the gap 62 to close the normally open valve 50. With the valve 50 thus closed, no further circulation of helium vapor can occur through the heat exchangers 32 and 38 thus ending the self-pressurization cycle of the container.

The gap 62 between the pneumatic activator and the normally open valve is adjustable and is important to the automatic operation of the self-pressurization system in that it provides a full flow of vapor in the heat exchangers over a wide range of pressure, and a rapid shutoff at the set pressure. In a conventional regulator, the plunger shafts are often connected. Thus, the flow of vapor gradually tapers off as the pressure approaches the set point. Due to the low pressure in the inner vessel (approximately 10 psi) and the need for precise shutoff control, the automatic valve with its adjustable gap of the present invention is highly desirable.

It should be understood, however, that the automatic valve arrangement including pipe 58, pneumatic activator 56, and normally open valve 50 may be removed from embodiment shown in FIG. 1 with the pipe 48 then becoming the vent to the atmosphere. In this embodiment, the operator simply opens valve 44 to pressurize the tank and then closes valve 44 to shutoff the pressurizing when sufficient pressure has been built up and/or the transfer of liquid helium has been completed.

Figure 2:
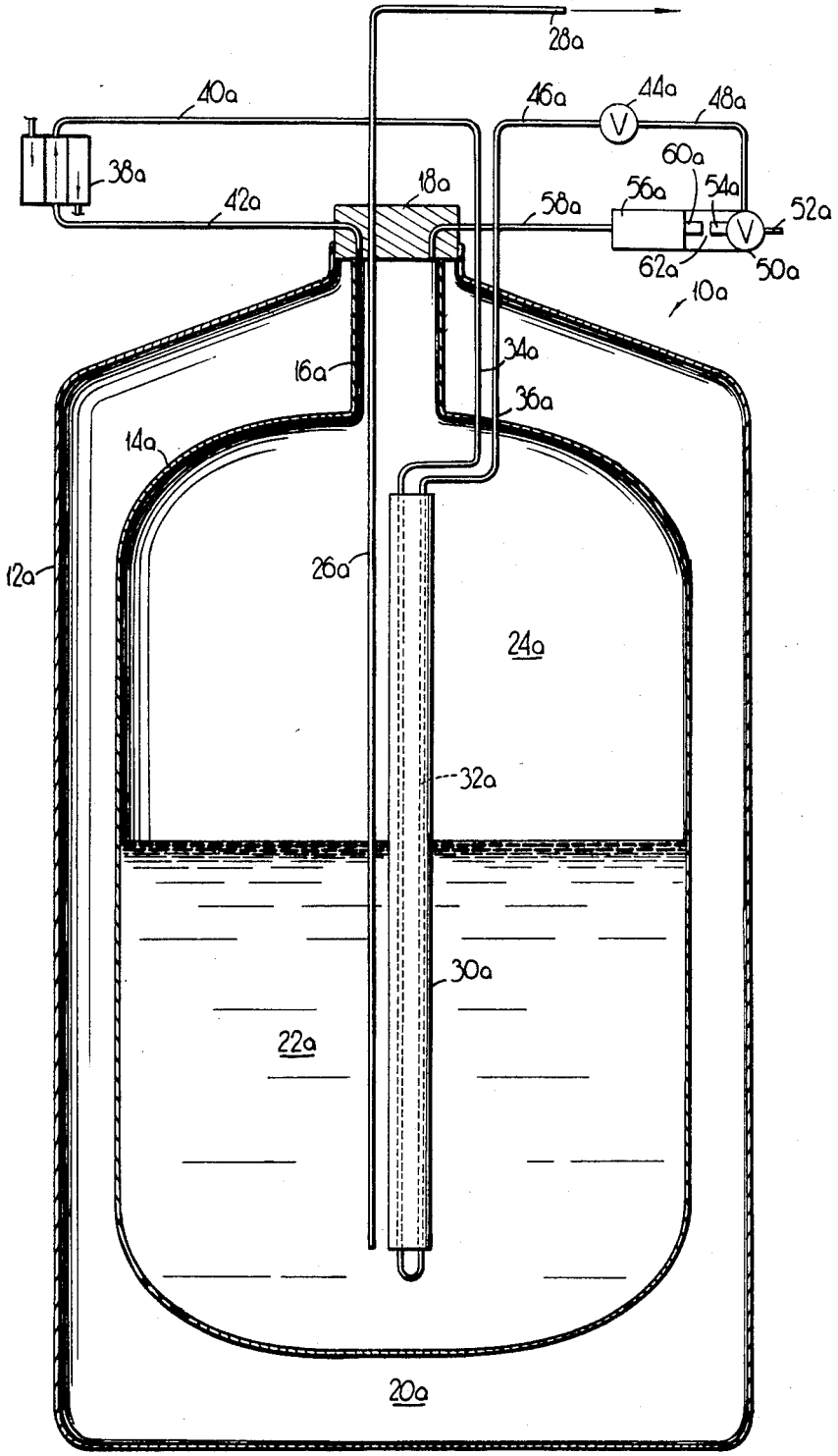
FIG. 2 is a schematic representation of a liquid helium container which embodies the present invention and shows an alternative embodiment.

FIG. 2 shows a second embodiment of the invention in which similar numbers identify similar parts of FIG. 1, but with the suffix "a" added. The inlet and outlet pipes 34*a* and 36*a* are connected from outside of the container to the inner vessel through the insulating space 20*a* as opposed to through the neck 16*a*. By disposing the inlet and outlet pipes 34*a* and 36*a* in the insulating space 20*a*, the heat transfer out of those pipes is minimized thus making the transfer of heat into the liquid helium slightly more efficient. Such, however, is not the preferred embodiment because of the mechanical complexity of providing the pipes 34*a* and 36*a* within the vacuum space.

Figure 3:
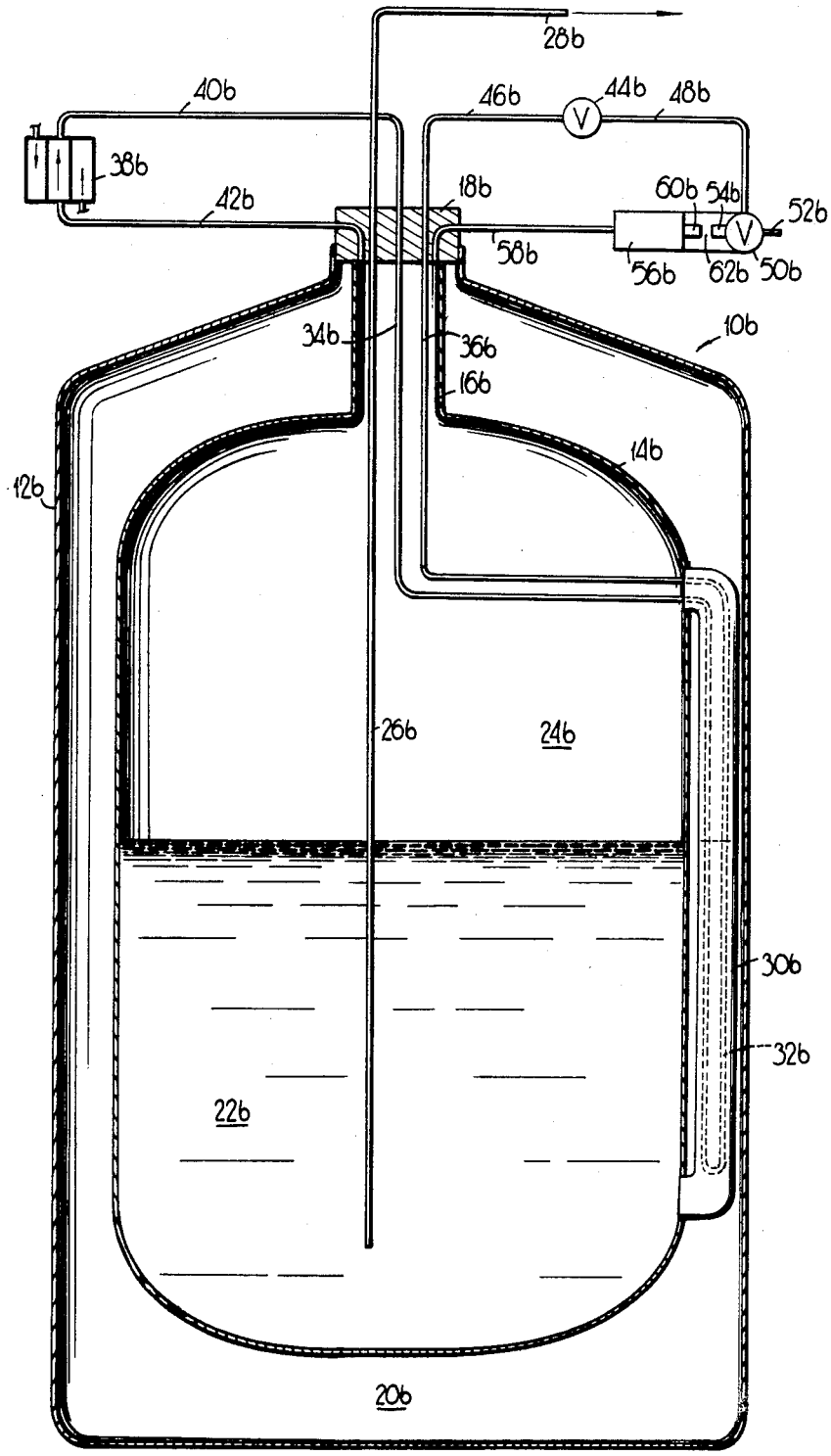
FIG. 3 is a schematic representation of a liquid helium container which embodies the present invention and shows yet another embodiment thereof.

FIG. 3 shows a further embodiment of the present invention in which the barrier tube 30*b* is disposed within the vacuum space 20*b* between the inner and outer vessels. Thus disposed within the vacuum space, there is even less heat transfer from the liquid helium in the barrier tube to the main body of liquid helium within the inner vessel. As a result, there is less heating of the main body of liquid helium and less chance of creating conditions over a long transfer which might result in flash-loss. Again, the added complexity of manufacture of the embodiment shown in FIG. 3 would be justified only if long periods of storage and transfer were required.

Figure 4:
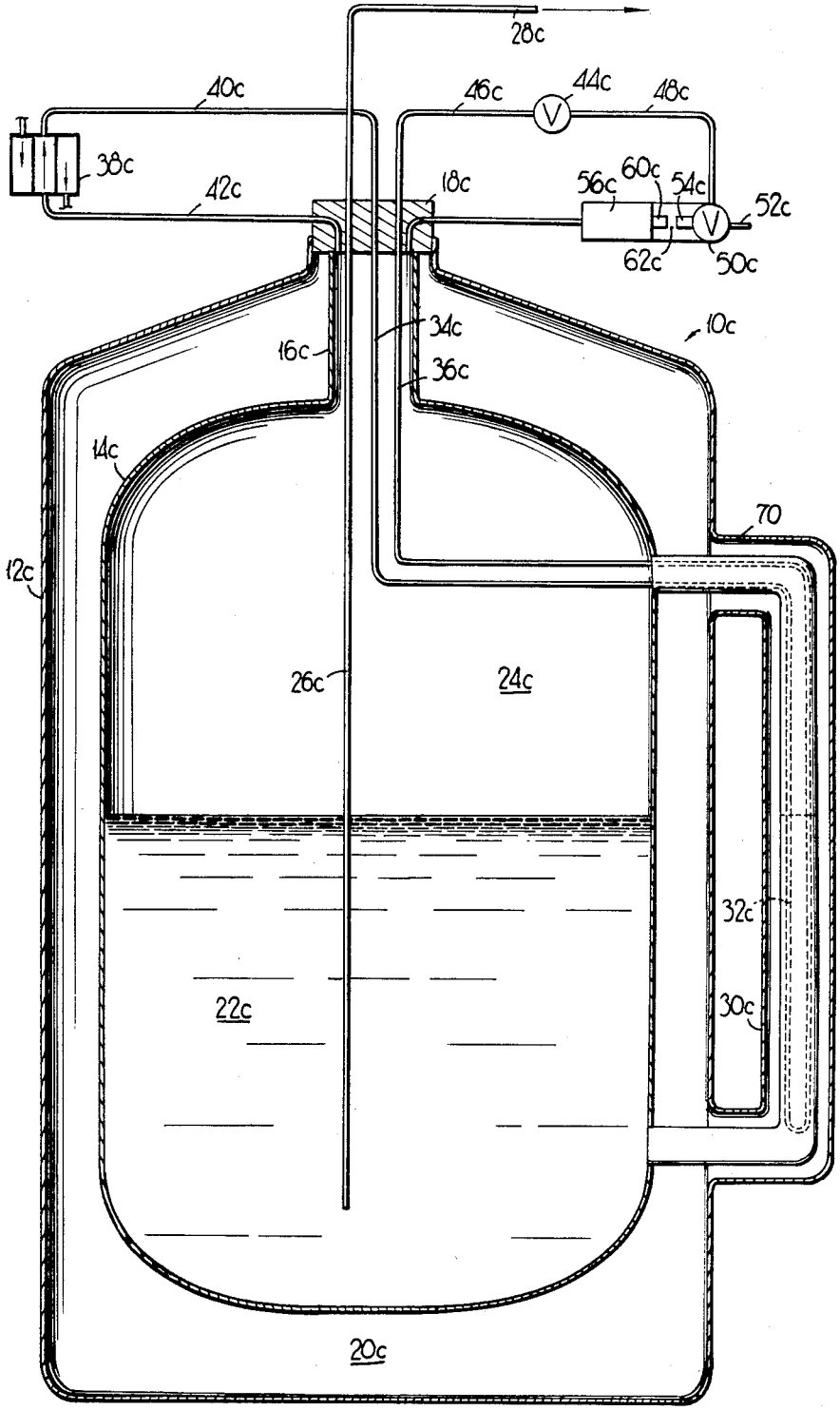
FIG. 4 is a schematic representation of a liquid helium container embodying the present invention which shows yet a further embodiment thereof.

The embodiment shown in FIG. 4 provides for the barrier tube 30*c* to be located in the vacuum space 20*c* within an external teacup handle 70. The embodiment shown in FIG. 4 provides even greater insulation between the liquid helium in the barrier tube 30*c* from the main body of liquid helium in the inner vessel. As a result, if long periods of storage and transfer are required, the embodiment shown in FIG. 4 may be desirable.

Figure 5:
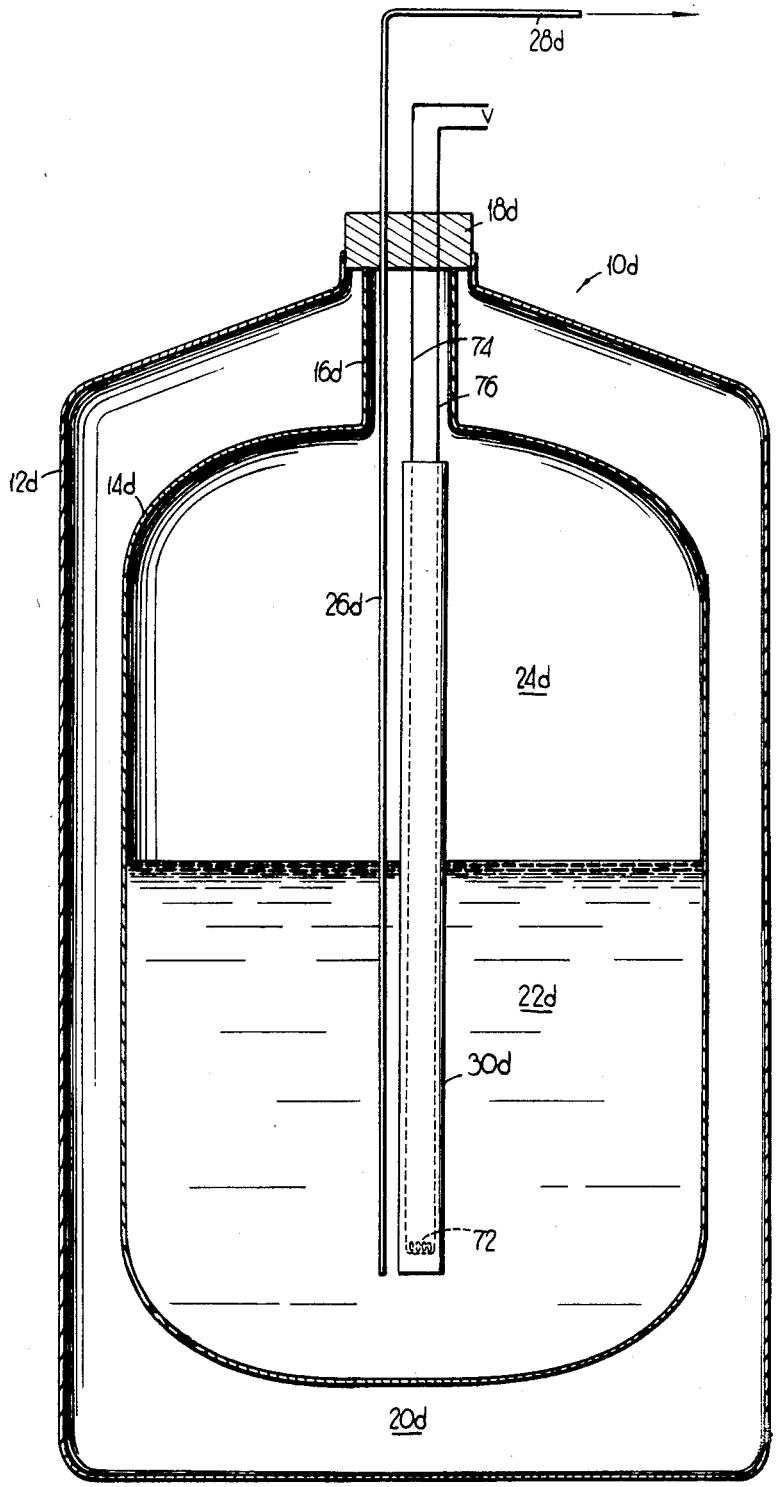
FIG. 5 is a schematic representation of a liquid helium container which illustrates an electrical heating means.

Instead of the heat exchangers 32 and 38 with their associated valving and tubing, the liquid helium within the barrier tube 30*d* may be heated by inserting an electric heating element 72 (FIG. 5) into the barrier tube 30*d* and connecting the heating element 72 via wires 74 and 76 to an external source of electric current (V). Thus pressurization is initiated by switching the electric heating element on and stopped by switching the electric heating element off.

Figure 6:
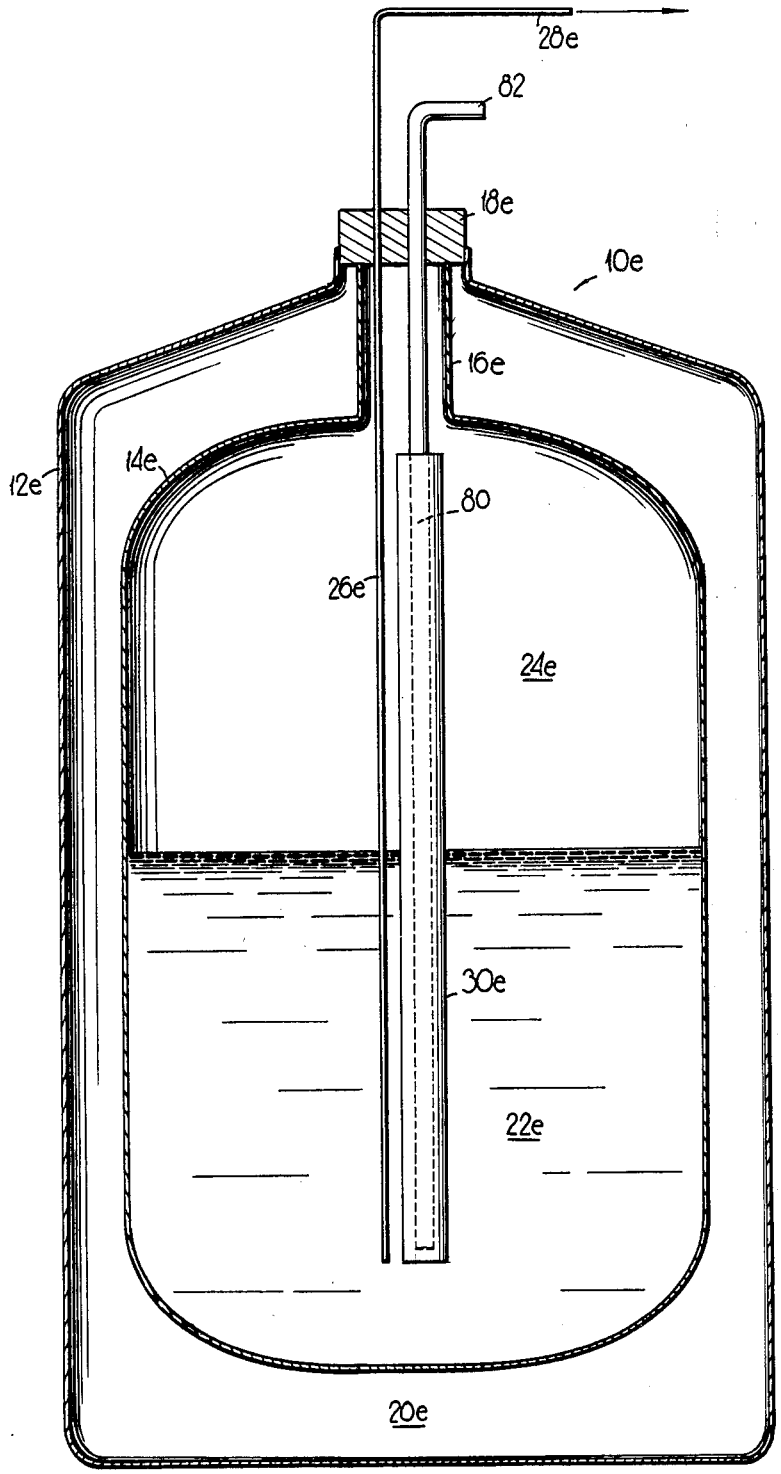
FIG. 6 is a schematic representation of a liquid helium container which illustrates a conductive rod used as heating means.

Another means of heating the liquid helium within the barrier tube is to insert a rod 80 (FIG. 6) of heat conductive material through the access port 18*e* into the liquid helium 22*e* within the barrier tube 30*e*. The rod 80 has its one end 82 outside of the access port and conducts the ambient heat into the barrier tube to vaporize the liquid helium within the barrier tube. The pressurization can be stopped by either removing the rod 80 from the container or by insulating the end 82 outside of the container.

I claim:

1. A self-pressurizing container for a cryogenic fluid existing as a liquid with its vapor phase disposed above the liquid, the container comprising:

(a) an outer vessel;

(b) an inner vessel for containing the cryogenic fluid;

(c) an insulating space between the vessels;

(d) a sealable access port connected to the inner vessel to provide sealed access from outside the outer vessel to inside of the inner vessel;

(e) a transfer tube extending from outside the outer vessel through the access port into the cryogenic liquid;

(f) open-ended barrier tube means extending between the cryogenic liquid and its vapor phase for conducting vapor formed from the liquid within the barrier tube to the vapor phase above the liquid in the inner vessel to pressurize the inner vessel and for insulating the liquid inside the barrier tube means from that liquid outside the barrier tube means;

(g) heating means for heating the liquid inside the barrier tube means to vaporize the liquid inside the barrier tube means without substantially heating the liquid outside the barrier tube means.

2. The container of claim 1, wherein the barrier tube means is inside the inner vessel.

3. The container of claim 1, wherein the barrier tube means is outside the inner vessel.

4. The container of claim 1, wherein the heating means comprises an electric heating element disposed within the barrier tube means.

5. The container of claim 1, wherein the heating means comprises a heat conductive material extending from outside the outer vessel into the barrier tube means and the material being exposed to a source of heat energy outside of the outer vessel.

6. The container of claim 1, wherein the heating means comprises first conduit means for conducting a portion of the vapor from the inner vessel to first heat exchanger means exposed to ambient temperature of the second vessel, second conduit means for conducting the vapor from the first heat exchanger means to second heat exchanger means inside the barrier tube means, third conduit means for conducting the vapor from the second heat exchanger means to outside the container, and first valve means for controlling the flow of vapor through the first, second, and third conduit means and through the first and second heat exchanger means.

7. The container of claim 6, wherein the heating means further includes automatic shutoff means comprising a normally opened valve means attached to the third conduit means and operated by a plunger, a pneumatic actuator means connect to the inner vessel to respond to the vapor pressure within the inner vessel, wherein the pneumatic actuator is spaced from the plunger by a gap so that the normally open valve means is closed after the pneumatic actuator spans the gap.

* * * * *